US006422055B1

(12) United States Patent
Ou et al.

(10) Patent No.: US 6,422,055 B1
(45) Date of Patent: Jul. 23, 2002

(54) POSITIONING APPARATUS FOR BENDING MACHINE

(75) Inventors: Chun Nan Ou, Taipei (TW); Hua Dong; Pupeng Hui, both of Shenzhen (CN)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 09/801,313

(22) Filed: Mar. 7, 2001

(30) Foreign Application Priority Data

Feb. 20, 2001 (TW) ..... 90202525 U

(51) Int. Cl.[7] ..... B21D 11/22

(52) U.S. Cl. ..... 72/461; 72/389.3; 72/16.2; 72/17.3; 72/420

(58) Field of Search ..... 72/419, 420, 389.3, 72/461, 16.2, 17.3

(56) References Cited

U.S. PATENT DOCUMENTS 4,357,821 A * 11/1982 Fowler ..... 72/389
4,706,491 A * 11/1987 Sartorio ..... 72/461
5,844,146 A * 12/1998 Murray et al. ..... 73/862.043
5,865,056 A * 2/1999 Nagakura ..... 72/461
6,269,677 B1 * 8/2001 Torvinen et al. ..... 72/461

* cited by examiner

*Primary Examiner*—David Jones
(74) *Attorney, Agent, or Firm*—Wei Te Chung

(57) ABSTRACT

A positioning apparatus (30) for a workpiece includes a base (310) with a shoulder (312), a positioning block (330) and a circuit. The positioning block includes an upper block (332) secured on the shoulder, and a lower block (334) having a front surface (336). A lay of insulator (320) is compressed between the base and the positioning block. The circuit includes a power source (50) and a relay (60). The power source provides direct current voltage. The relay comprises a coil (601) electrically connected between the power source and the positioning block, and a normal-open switch (603) electrically connected between the power source and a manipulator which acts on the workpiece. When the workpiece contacts the front surface of the positioning block, the coil is electrified and the normal-open switch closes. The interface of the manipulator turns to high level, and the manipulator starts its next programmed motion.

12 Claims, 4 Drawing Sheets

POSITIONING APPARATUS FOR BENDING MACHINE

BACKGROUND OF THE INVENTION

1. Field of the Invention

The present invention relates to a bending machine, and particularly to a positioning apparatus for precisely positioning workpieces on the bending machine.

2. Description of Related Art

With rapid developments in manufacturing industry, the demand for precision components is constantly increasing. A mechanical manipulator is often used to feed workpieces to a workbench in a bending machine, instead of using manual feeding. In order to precisely positioning the workpieces in the workbench, the manipulator itself must be precisely positioned.

FIG. 4 shows a conventional positioning apparatus 10 behind a lower die 20 of a bending machine (not shown). The positioning apparatus 10 comprises two generally symmetrical positioning blocks 101. Each positioning block 101 comprises a shoulder 102 with a front surface 103. Two approaching switches 105 are respectively installed on mutually opposing sides of the two positioning blocks 101. Each approaching switch 105 extends slightly beyond the front surface 103 of the corresponding positioning block 101. A post 107 is formed on one of the mutually opposing sides of the two positioning blocks 101. The post 107 is adapted to prevent the two approaching switches 105 from contacting each other and generating an error signal.

In operation, a manipulator (not shown) takes hold of a workpiece (not shown) and puts it onto the lower die 20. Then the manipulator horizontally pushes the workpiece toward the positioning apparatus 10. When the workpiece contacts the approaching switches 105, the approaching switches 105 are moved backward. The workpiece is continued to be pushed by the manipulator. When front walls (not labeled) of the approaching switches 105 become coplanar with the front surfaces 103 of the positioning apparatus 10, the workpiece is blocked by the positioning apparatus 10 and is positioned in the bending machine (not shown) ready for bending. A sensor (not shown) electrically connected with the approaching switches 105 sends a signal to the manipulator indicating that the workpiece is positioned ready for bending. The manipulator thereupon stops pushing the workpiece.

The conventional apparatus has a number of shortcomings. The approaching switches 105 have a range of tolerance, such that the workpiece cannot be precisely positioned. Furthermore, when the positioning width of the workpiece is narrow or the shape of the workpiece is unusual, the two approaching switches 105 cannot be used simultaneously. This reduces the precision of positioning of the workpiece. Moreover, the approaching switches 105 are relatively expensive.

SUMMARY OF THE INVENTION

Accordingly, an object of the present invention is to provide a positioning apparatus which can precisely position a workpiece having a narrow positioning width.

Another object of the present invention is to provide a positioning apparatus which can precisely position a workpiece having an unusual shape.

A further object of the present invention is to provide a positioning apparatus which is inexpensive.

In order to achieve the above-mentioned objects, a positioning apparatus for a workpiece in accordance with the present invention comprises a base, a positioning block and a circuit. The base comprises a shoulder defining a screw hole therethrough. The positioning block comprises an upper block, and a lower block having a front surface. The upper block defines a shoulder hole, for extension of a bolt therethrough to engage in the screw hole of the base. The bolt thereby secures the positioning block on the shoulder of the base. Layers of insulator are compressed between the base and the positioning block, and between the base and the bolt. The layers insulate the base and the positioning block from each other. The circuit comprises a power source and a relay. The power source provides direct current voltage. The relay comprises a coil electrically connected between the power source and the positioning block, and a normal-open switch electrically connected between the power source and a manipulator which acts on the workpiece. When the workpiece contacts the front surface of the positioning block, the coil is electrified and the normal-open switch closes. The interface of the manipulator turns to high level. The manipulator starts its next programmed motion, leaving the workpiece in its correct position.

Other objects, advantages and novel features of the invention will become more apparent from the following detailed description when taken in conjunction with the accompanying drawings.

DETAILED DESCRIPTION OF THE PREFERRED EMBODIMENT

Figure 1:
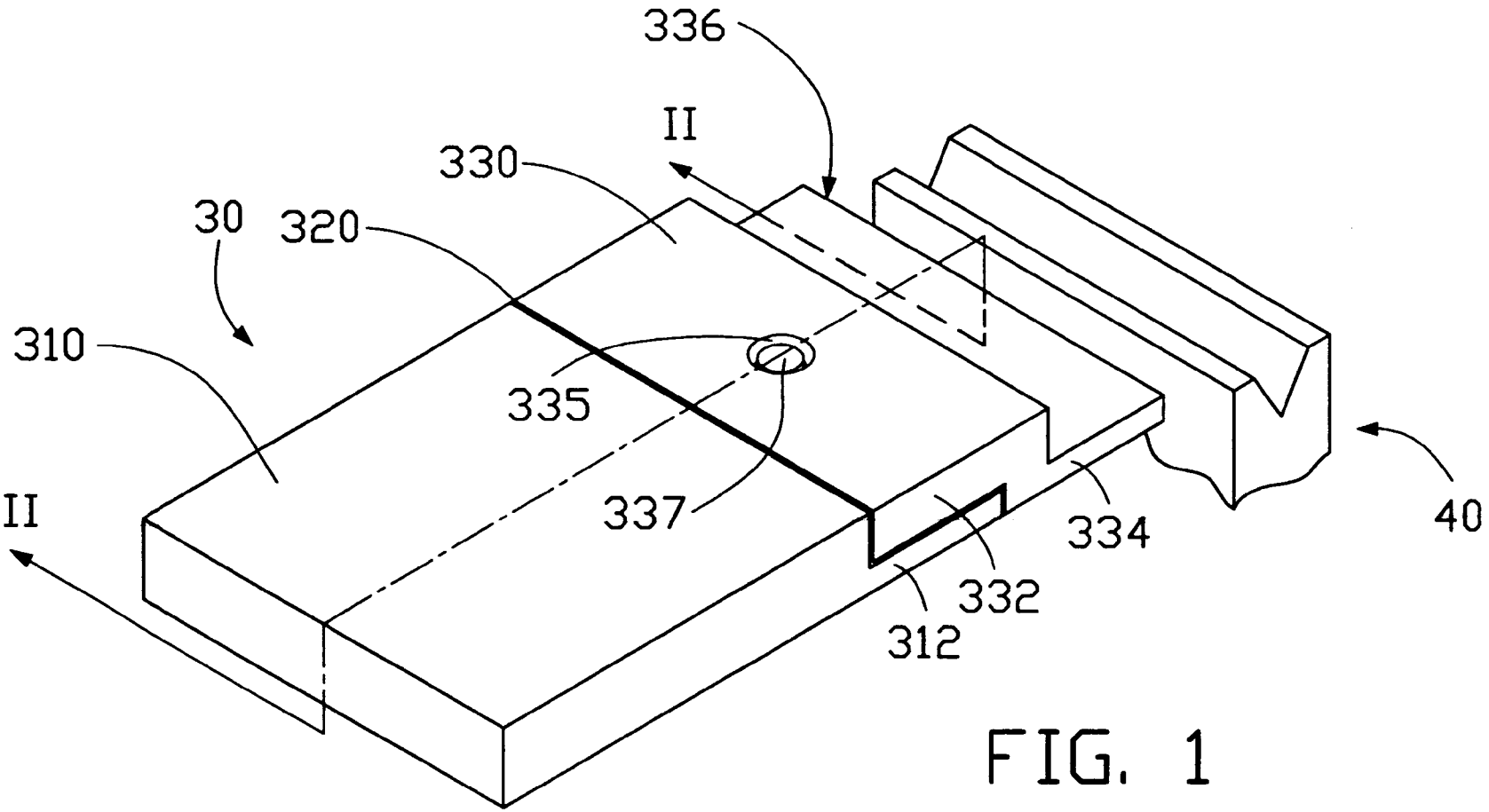
FIG. 1 is a perspective view of a positioning apparatus of the present invention, together with part of a lower die of a bending machine.

Reference will now be made to the drawing figures to describe the preferred embodiment of the present invention in detail.

Figure 2:
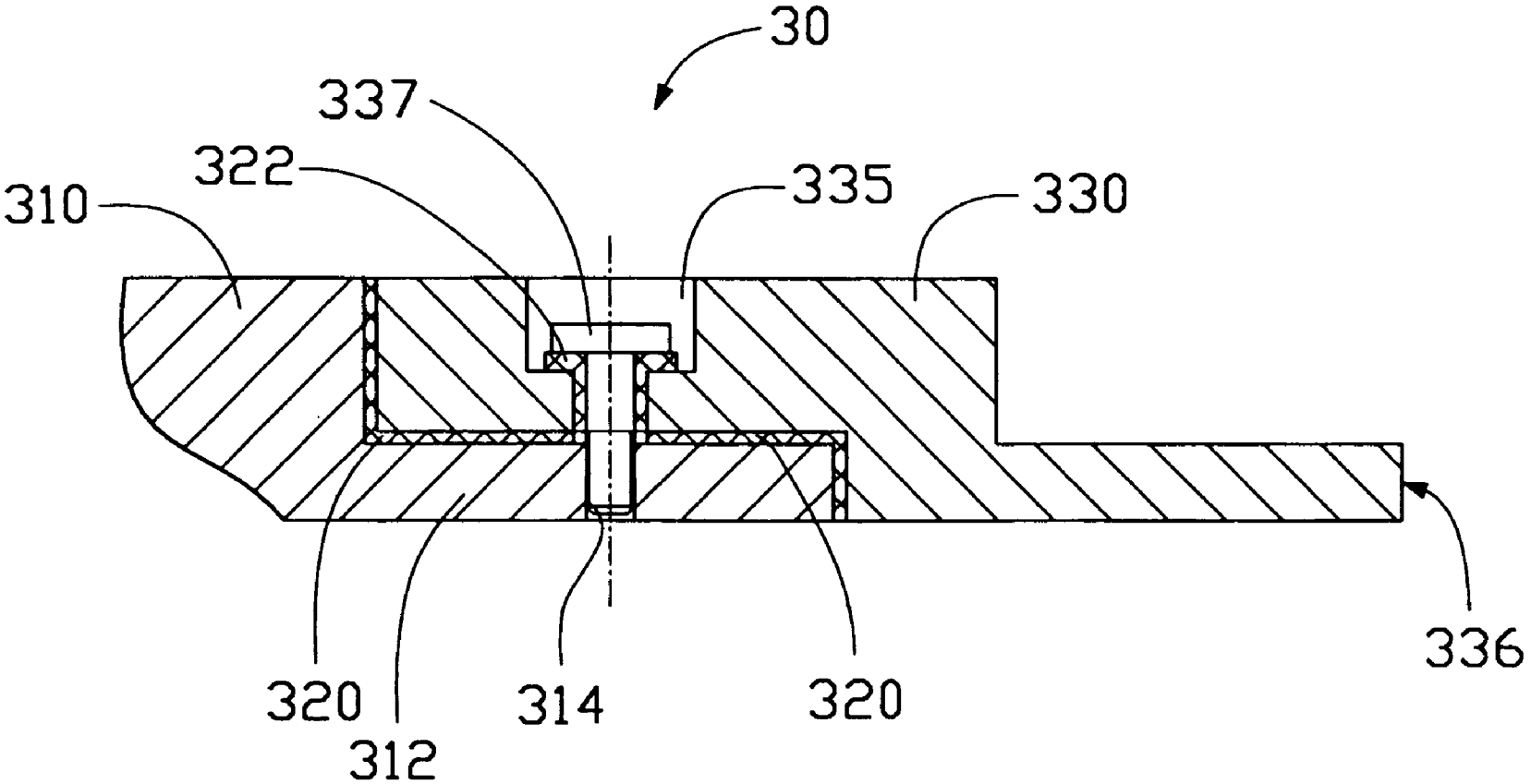
FIG. 2 is a cross-sectional view of the positioning apparatus of FIG. 1, taken along line II—II of FIG. 1.

Referring to FIGS. 1–2, a positioning apparatus 30 of a bending machine (not shown) of the present invention comprises a base 310 and a positioning block 330. The positioning apparatus 30 is located behind a lower die 40 of the bending machine (not shown).

The base 310 has a shoulder 312 at a front portion thereof. A screw hole 314 is defined in the shoulder 312. The positioning block 330 is generally "Z" shaped in profile, and comprises an upper block 332 and a lower block 334. A shoulder hole 335 is defined in the upper block 332, coaxial with the screw hole 314 of the base 310. The upper block 332 of the positioning block 330 is secured on the shoulder 312 of the base 310 by a bolt 337 which extends through the shoulder hole 335 to engage in the screw hole 314 of the base 310. The lower block 334 has a front surface 336 opposing the lower die 40. A first layer of insulator 320 is compressed between the base 310 and the positioning block 330. A second layer of insulator 322 is compressed between the upper block 332 of the positioning block 330 and the bolt 337. Thus the base 310 and the positioning block 330 are completely electrically insulated from each other.

Figure 3:
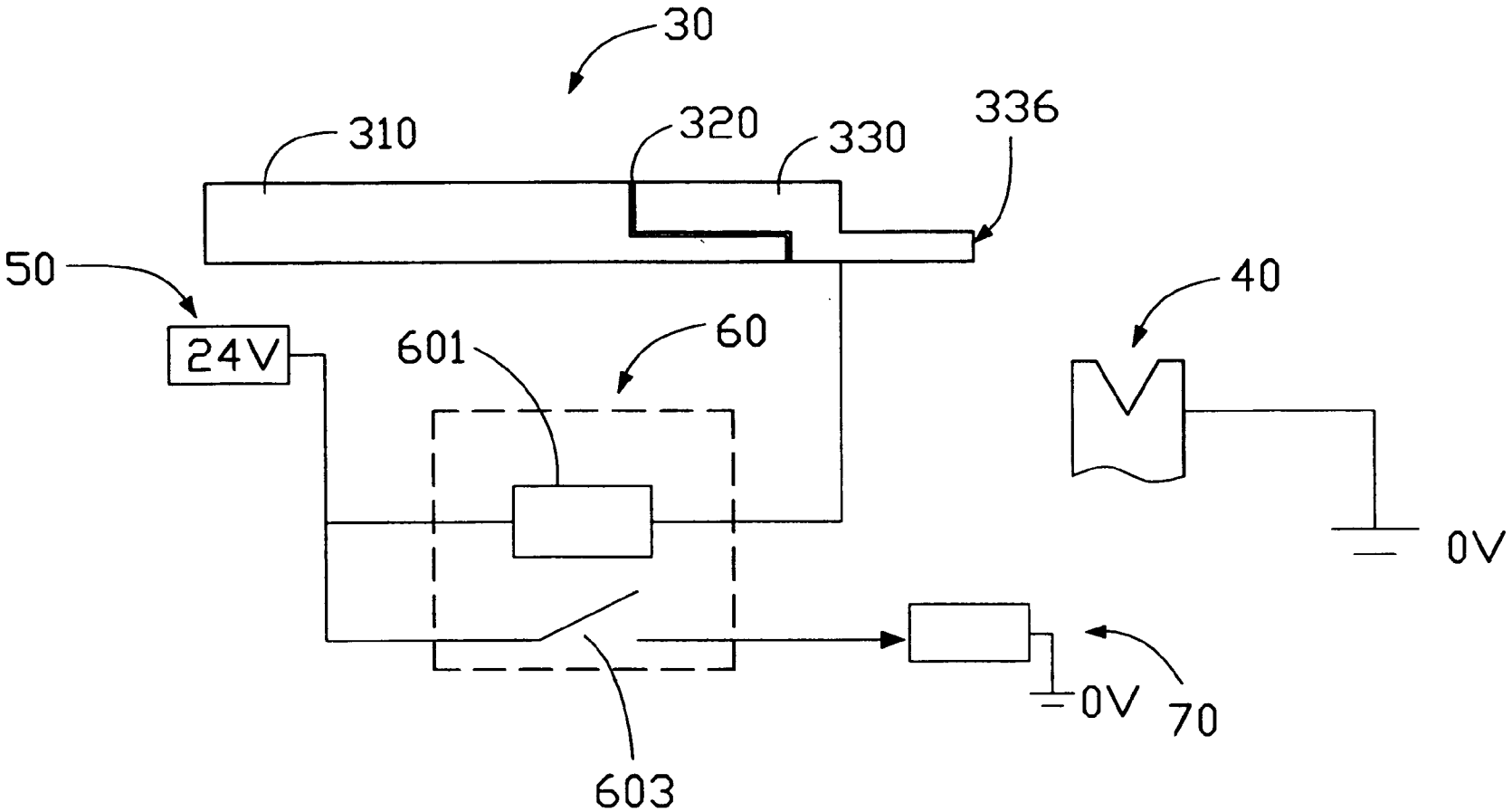
FIG. 3 is a side elevational view of the positioning apparatus and lower die of FIG. 1, together with a circuit diagram thereof.
Figure 4:
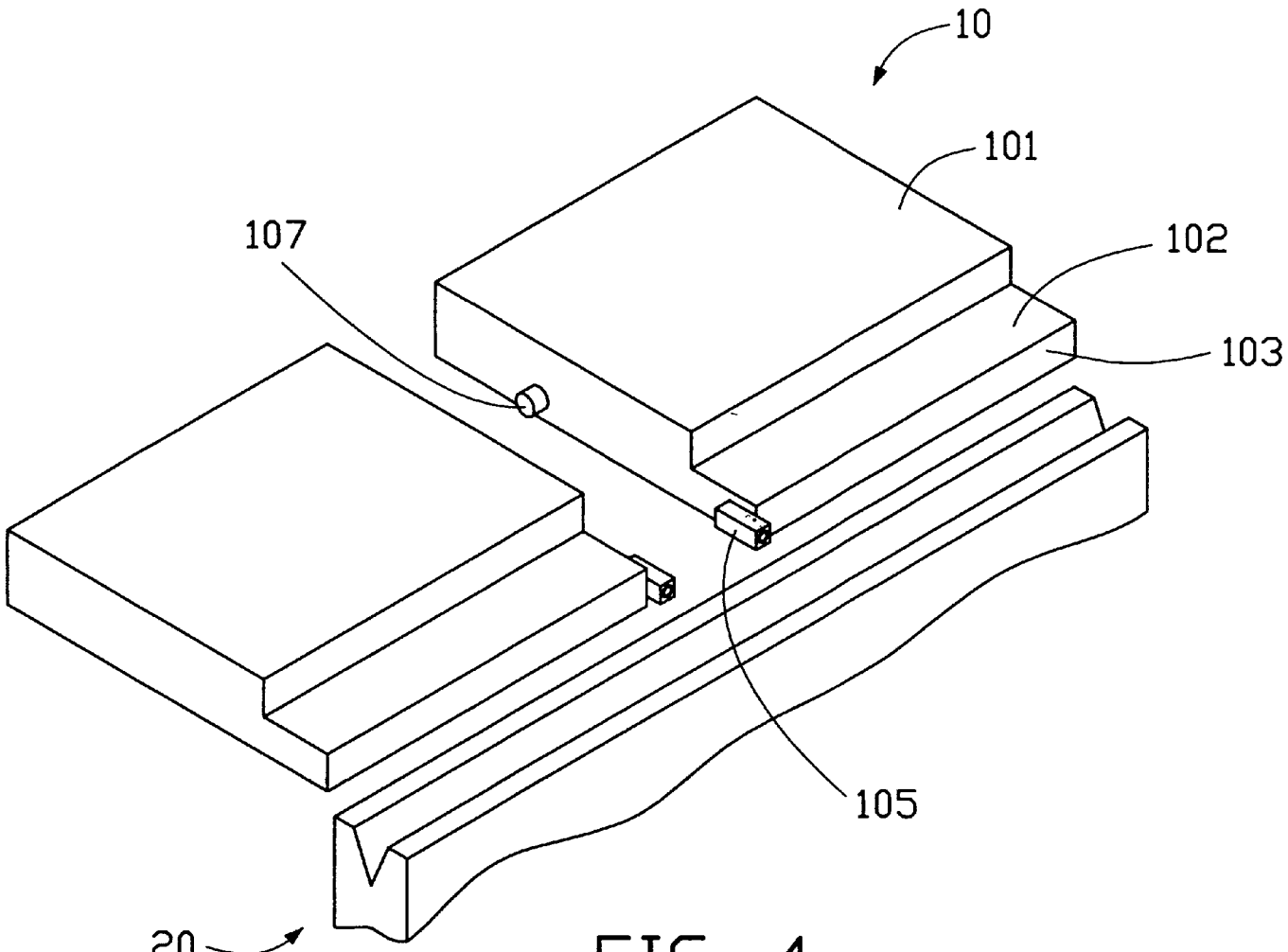
FIG. 4 (RELATED ART)
FIG. 4 is an exploded view of a conventional positioning apparatus and part of a lower die of a bending machine.

Referring also to FIG. 3, the positioning apparatus 30 further comprises a circuit comprising a power source 50 and a relay 60. The power source 50 provides direct current power of 24 volts. The relay 60 comprises a coil 601 and a normal-open switch 603. The coil 601 is electrically connected between the power source 50 and the positioning block 330. One end of the normal-open switch 603 is connected with the power source 50. The other end of the normal-open switch 603 is connected with a manipulator 70 which acts on a workpiece (not shown). The lower die 40 and the manipulator 70 are commonly grounded. The workpiece (not shown) is electrically conductive.

In operation, the power source 50 is switched on. The manipulator 70 takes hold of the workpiece (not shown) and puts it onto the lower die 40. The workpiece (not shown) electrically connects with the lower die 40. The manipulator 70 then horizontally pushes the workpiece toward the positioning apparatus 30. When the workpiece contacts the front surface 336 of the positioning block 330, a closed circuit is created between the lower die 40, the positioning block 330, the relay 60 and the power source 50. The coil 601 of the relay 60 is electrified, and the normal-open switch 603 closes. As a result, an electrical signal is sent to the manipulator 70 from the power source 50, informing the manipulator 70 that the workpiece is already in position. The manipulator 70 thereupon stops pushing the workpiece, and starts its next programmed motion.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A positioning apparatus for positioning a workpiece, comprising:

a base having a shoulder defining a screw hole;

a positioning block secured on and electrically insulated from the base, the positioning block having a surface and comprising a lower block and an upper block defining a shoulder hole for extension of a bolt therethrough to engage in the screw hole;

a power source adapted for providing electrical current; and an electrical device electrically connected between the positioning block and the power; wherein when a workpiece manipulator moves the workpiece to contact the surface, the power source sends a signal to the workpiece manipulator via the electrical device informing the manipulator that the workpiece is in position and the manipulator then starts a subsequent motion.

2. The positioning apparatus as claimed in claim 1, wherein insulator is disposed between the positioning block and the base.

3. The positioning apparatus as claimed in claim 1, wherein insulator is disposed between the upper block and the bolt.

4. The positioning apparatus as claimed in claim 1, wherein the electrical device is a relay comprising a coil and a normal-open switch.

5. The positioning apparatus as claimed in claim 4, wherein the coil is electrically connected between the positioning block and the power source.

6. The positioning apparatus as claimed in claim 4, wherein the normal-open switch is electrically connected between the power source and the manipulator, and when the workpiece contacts the surface of the positioning block the normal-open switch closes.

7. A positioning apparatus assembly for positioning a workpiece, comprising:

a base having a shoulder in a front portion thereof;

a positioning block secured on and electrically insulated from the base, the positioning block comprising an upper block engaged on the shoulder and a lower block in front of the upper block, the lower block having a surface;

a lower die adapted for forming the workpiece;

a manipulator adapted for moving the workpiece;

a power source adapted for providing electrical current; and an electrical device electrically connected between the positioning block and the power source, wherein when the workpiece is moved by the manipulator to contact the surface and the lower die, the power source sends a signal to the manipulator via the electrical device and the manipulator then starts a subsequent motion.

8. The positioning apparatus assembly as claimed in claim 7, wherein the lower die and the manipulator are commonly grounded.

9. The positioning apparatus assembly as claimed in claim 7, wherein the electrical device is a relay comprising a coil and a normal-open switch.

10. The positioning apparatus assembly as claimed in claim 9, wherein the coil is electrically connected between the positioning block and the power source.

11. The positioning apparatus assembly as claimed in claim 9, wherein the normal-open switch is electrically connected between the power source and the manipulator, and when the workpiece contacts the lower die and the surface of the positioning block the normal-open switch closes and the signal is sent to the manipulator informing the manipulator that the workpiece is in position.

12. The positioning apparatus assembly as claimed in claim 7, wherein the shoulder defines a screw hole, and the upper block defines a shoulder hole for extension of a bolt therethrough to engage in the screw hole.

* * * * *